United States Patent [19]

Douglas

[11] Patent Number: 4,682,026

[45] Date of Patent: Jul. 21, 1987

[54] METHOD AND APPARATUS HAVING RF BIASING FOR SAMPLING A PLASMA INTO A VACUUM CHAMBER

[75] Inventor: Donald J. Douglas, Toronto, Canada

[73] Assignee: MDS Health Group Limited, Rexdale, Canada

[21] Appl. No.: 850,188

[22] Filed: Apr. 10, 1986

[51] Int. Cl.[4] ..... H01J 49/10

[52] U.S. Cl. ..... 250/288; 250/281; 250/282; 250/423 R; 315/111.81

[58] Field of Search ..... 250/288, 288 A, 281, 250/282, 423 R; 315/39, 111.81

[56] References Cited

U.S. PATENT DOCUMENTS 3,944,826 3/1976 Gray ..... 250/288

4,501,965 2/1985 Douglas ..... 250/288

*Primary Examiner*—Craig E. Church

*Assistant Examiner*—Jack I. Berman

*Attorney, Agent, or Firm*—Rogers, Bereskin & Parr

[57] ABSTRACT

A plasma generated within an induction coil is sampled through a sampler orifice into a first vacuum chamber stage and then through a skimmer orifice into a second vacuum chamber stage for mass analysis of trace ions in the plasma. Arcing at the orifices is reduced or prevented by applying, to the plates containing the orifices, an RF bias voltage derived from the generator which powers the coil. Since optimum ion transmission is highly dependent on the phase and amplitude of the RF bias, phase and amplitude adjustment networks are provided to optimize the ion count. Alternatively, arcing at the sampler orifice can be eliminated by grounding the induction coil at or near its center and the RF bias can be applied only to the plate containing the skimmer orifice.

19 Claims, 6 Drawing Figures

METHOD AND APPARATUS HAVING RF BIASING FOR SAMPLING A PLASMA INTO A VACUUM CHAMBER

BACKGROUND OF THE INVENTION

This invention relates to method and apparatus for sampling an inductively generated plasma through an orifice into a vacuum chamber and to method and apparatus for mass analysis using such sampling. The invention relates to an alternative to the method and apparatus described in my U.S. Pat. No. 4,501,965, which alternative can also be used in conjunction with the method and apparatus shown in that patent. The present invention will be described with reference to mass analysis.

BRIEF SUMMARY OF THE INVENTION

As described in my above identified U.S. patent, it is often desired to analyze a sample of a substance by introducing the sample into a high temperture plasma. The plasma produces predominantly singly charged ions of the elements in the substance. The ions are then introduced from the plasma into a vacuum chamber containing a mass analyzer, to detect the presence of trace substances in the sample. Difficulties have been encountered in extracting a sample of the plasma from the main body of the plasma and directing it through a small orifice into the vacuum chamber. My above identified U.S. patent describes method and apparatus for improving sampling from the plasma into the vacuum chamber, by reducing the voltage swing which was found to exist in the plasma. This arrangement greatly reduced the problems of arcing at the orifice. Such arcing causes erosion of the orifice, sputtering of the orifice material producing a background spectrum of the orifice material which interfers with the desired spectrum, generation of a high level of doubly charged ions, and generation of ultraviolet photon noise.

The present invention provides an alternative arrangement for reducing the problem of arcing, by providing appropriate radio frequency (RF) biasing of the orifice plate. In one aspect the invention provides apparatus for sampling ions in a plasma into a vacuum chamber comprising:

(a) means for generating a plasma, including (i) an electrical induction coil having first and second terminals and at least one turn between said first and second terminals, said turn defining a space within said coil for generation of said plasma, and (ii) generating means for generating a first RF voltage to apply to said coil to provide heating within said space to generate said plasma, (b) a vacuum chamber including an orifice plate defining a wall of said vacuum chamber, (c) said orifice plate having an orifice therein located adjacent said space for sampling a portion of said plasma through said orifice into said vacuum chamber, (d) second generating means for generating a second RF voltage of frequency the same as that of said first RF voltage and phase locked to said first RF voltage, (e) and means connected between said orifice plate and said second generating means for biasing said orifice plate with said second RF voltage to increase the flow of said ions through said orifice.

In another of its aspects the present invention supplements the arrangement shown in my above identified U.S. patent. In the arrangement shown in such patent, the voltage swing in the plasma was greatly reduced, but some residual voltage swing remains because of heating currents in the plasma and because of other effects not fully understood. At least the voltage from the heating currents cannot be eliminated. The residual voltage swing may still cause some residual arcing, particularly adjacent the entrance to the second stage of the vacuum chamber shown in such U.S. patent. Use of the invention shown in my above identified U.S. patent, combined with RF biasing of the orifice plate into the second stage of the vacuum chamber according to the present invention, has been found to produce a further improvement in ion signal transmission into the second stage of the vacuum chamber. Accordingly in another of its aspects the present invention provides apparatus for sampling a plasma into a vacuum chamber comprising:

(a) means for generating a plasma, including (i) an electrical induction coil having first and second terminals and at least one turn between said first and second terminals, said turn defining a space within said coil for generation of said plasma, and (ii) RF generating means for generating a first RF voltage to apply to said coil to provide heating within said space to generate said plasma, (b) a vacuum chamber having first and second vacuum stages and including a sampler plate defining an outer wall of said vacuum chamber, said sampler plate having a sampler orifice therein, and a skimmer plate within said vacuum chamber and having a skimmer orifice therein, said sampler plate and skimmer plate being spaced to define between them said first vacuum stage, said vacuum chamber having a second wall spaced from said skimmer plate, said second wall and said skimmer plate defining between them said second vacuum stage, (c) said sampler orifice and said skimmer orifice being located to sample a portion of said plasma through said sampler orifice into said first vacuum stage and through said skimmer orifice into said second vacuum stage, (d) and means coupled to said RF generating means for producing a first RF bias voltage and for applying said RF bias voltage at least to said skimmer plate to increase the flow of ions through said skimmer orifice.

BRIEF DESCRIPTION OF THE DRAWINGS

Further objects and advantages of the present invention will appear from the following description, taken together with the accompanying drawings in which.

DETAILED DESCRIPTION OF PREFERRED EMBODIMENTS

Figure 1:
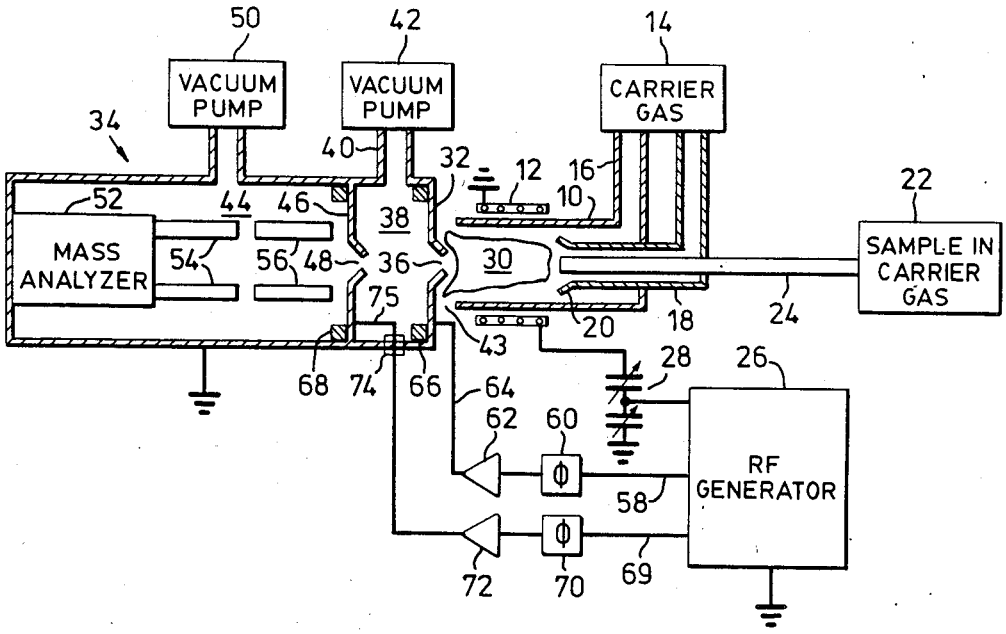
FIG. 1 is a diagrammatic view (not to scale) showing apparatus for mass analysis according to the present invention.

Reference is first made to FIG. 1, which shows a plasma tube 10 around which is wound an electrical induction coil 12. The carrier gas, e.g. argon, used to form the plasma is supplied from a source 14 and is directed by a conduit 16 into the plasma tube 10. A further stream of the carrier gas is directed from the source 14 throu an inner tube 18 within the plasma tube 10 and exits via a flared end 20 just upstream of the coil 12. The sample gas containing the trace substance to be analyzed is supplied in a carrier gas, e.g. argon, from source 22 and is fed into the plasma tube 10 through a tube 24 within and coaxial with the tube 18. Thus the sample gas is released into the center of the plasma to be formed.

The coil 12 normally has a small number of turns (four turns are shown in the drawing) and is supplied with RF power froman RF generator 26 which may include an impedance matching network 28. The RF power fed to the coil 12 varies depending on the nature of the plasma required and may range between 200 and 10,000 watts. The RF frequency used is high, typically 27 megahertz (MHz). The plasma generated by this arrangement is indicated at 30 and is at atmospheric pressure.

The plasma tube 10 is located adjacent a sampler plate 32 which defines one end wall of a vacuum chamber 34. Sampler plate 32 is water cooled, by means not shown. The plasma 30 is sampled througn an orifice 36 in the sampler plate 32 into a first vacuum chamber stage 38 which is evacuated through duct 40 by a pump 42. (The sampling orifice 36 is in practice usually machined in a separate piece called a sampler which is in good electrical contact with the sampler plate 32.) The remaining gases from the plasma exit through the space 43 between the plasma tube 10 and the plate 32.

The first stage 38 of the vacuum chamber 34 is separated from a second vacuum chamber stage 44 by a skimmer plate 46 containing a second orifice 48. (The skimmer orifice is also usually machined in a separate piece called a skimmer, which is in good electrical contract with the skimmer plate 46.) The second stage 44 of the vacuum chamber is evacuated by a vacuum pump 50. Located in the second vacuum chamber stage 44 is a mass analyzer indicated at 52. The mass analyzer may be a quadrupole mass spectrometer having analyzing rods 54. In addition, located between the rods 54 and the skimmer plate orifice 48 are conventional ion optic elements indicated at 56. The ion optic elements 56 may include perforated quadrupole rods having RF power only applied thereto (without any d.c. applied thereto), as shown in U.S. Pat. No. 4,328,420 issued to J. B. French et al, and may also include a standard bessel box lens located between such RF only rods and the analyzing rods 54.

According to the invention a sample of the RF voltage is picked off the generator 26 via lead 58, adjusted in phase at phase adjusting network 60, adjusted in amplitude in amplifier 62, and applied via lead 64 to the sampler plate 32. The sampler pate 32 is d.c. electrically insulated from ground by insulating ring 66 but may have a considerable capacitance to ground. No special means (of the kind shown in my above identified U.S. patent) were used to reduce the voltage swing in the plasma 24.

When no RF bias was applied to the sampler plate 32, and whether or not the sampler plate 32 was insulated from ground, arcing between the plasma and the sampler plate 32 at the orifice 36 was observed. When RF bias from the lead 64 was applied to the sampler plate 32 and the phase was adjusted correctly, the arcing was observed to be extinguished. If the phase of the RF bias was reversed 180°, the arcing was not eliminated and in fact may have been increased. The reasons for this appears to be that since the sampler plate 32 whether insulated or not is always at or near RF ground because of its large capacitance to ground, therefore the voltage difference between the plasma 30 and the sampler plate 32 normally causes arcing. If the RF voltage applied to the sampler plate is in phase with the peak-to-peak voltage swing in the plasma, then the voltage difference between the sampler plate 32 and the end of the plasma 30 closest tot he sampler plate 32 is reduced and arcing is eliminated. When the phase is reversed, the voltage difference is not reduced and can in fact be increased, so that arcing is not eliminated.

In some cases the plasma may arc not only to the sampler plate 32 at the orifice 36 but also to the skimmer plate 46 at the orifice 48. Such arcing may occur in part because the skimmer plate may be in fairly good electrical contact with the plasma 30, particularly where a large sampler orifice 36 is used. In addition, if the sampler plate 32 is biased with RF and the skimmer plate 46 is grounded, the RF bias itself may cause a discharge in the low pressure region in the first stage 38 of the vacuum chamber due to the RF voltage difference between these two plates. Such a discharge has many of the same deleterious effects as a discharge caused by the voltage between the plasma 30 and the sampler plate 32 or skimmer plate 46.

The arcing between the skimmer plate 46 at orifice 48 and the plasma or adjacent elements may also be reduced or eliminated, by insulating the skimmer plate from ground by insulating ring 68, and by also biasing the skimmer plate 46 with RF. Such biasing may be applied by deriving another sample of the RF voltage from generator 26 via lead 69, passing it through a phase adjusting network 70 and an amplifier 72, and then applying it through vacuum feed through 74 and lead 75 to the skimmer plate 46, as shown in FIG. 1.

Figure 2:
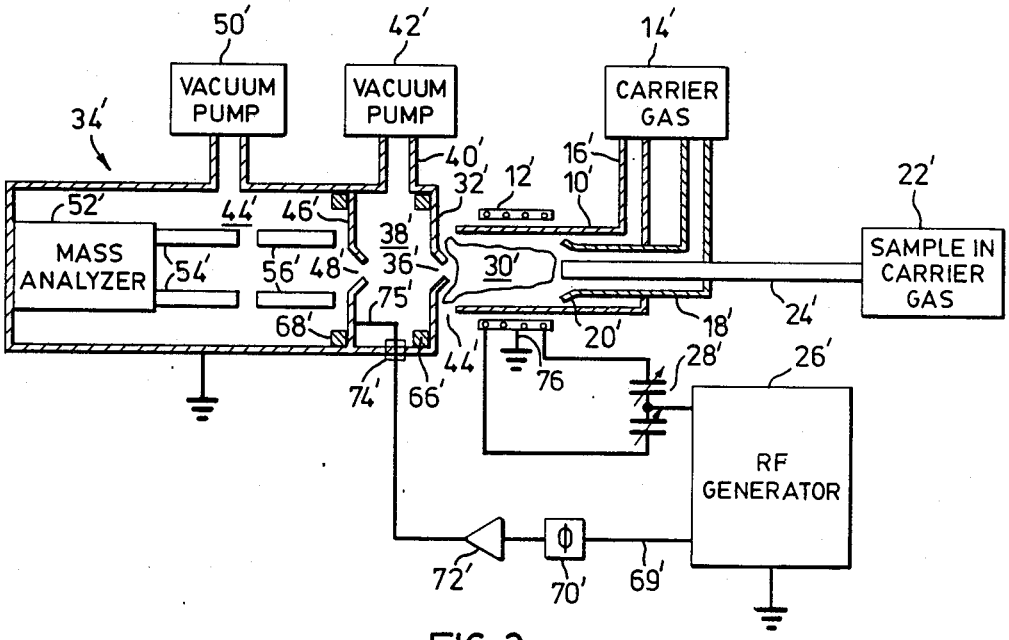
FIG. 2 is a diagrammatic view (not to scale) showing modified apparatus for mass analysis according to the present invention.

Reference is next made to FIG. 2, which shows aparatus the same as that of FIG. 1 except as will be explained, and in which primed reference numerals indicated corresponding parts. The FIG. 2 arrangement differs from that of FIG. 1 in that the sampler plate 32' is not RF biased and one end of the coil 12' is not grounded. Instead the coil 12' has a ground connected to a point 76 between the ends of the coil, near the center of the coil, as shown, in accordance with the arrangement shown in my above identified patent. This eliminates arcing between the plasma 30' and the sampler plate 32' at orifice 36' and therefore also eliminates the need to RF bias the sampler plate 32'. However the skimmer plate 46' is still RF biased through the phase adjusting network 70' and the amplifier 72'.

It is found that using the FIG. 2 apparatus, substantial improvements both in the ion transmission and background noise level are obtained when the RF bias applied to the skimmer plate 46' is of both correct phase and amplitude.

In a first experiment the phase and amplitude of the RF bias applied to the skimmer plate 46' in the FIG. 2 arrangement were adjusted for the best signal using a one microgram per milliliter vanadium solution. With the particular apparatus and operating conditions used, the ion signal was 89,000 counts per second and the background noise was 66 counts per second when the RF bias was adjusted to the optimum phase and amplitude. When the RF bias was removed and the skimmer simply grounded at the feed through 74', the signal dropped to 17,500 counts per second and the background noise increased to 427 counts per second. The signal to background noise ratio therefore decreased by a factor of 35 when the optimum RF bias was removed. However it was subsequently found that the loss of signal to noise in going from an RF biased skimmer plate 46' to a grounded skimmer could be decreased by grounding the skimmer plate 46' directly to the vacuum system, i.e. by bolting it directly to the vacuum system rather than grounding it through the lead 75' which was approximately four inches long. It appears that the inductance of even a four inch wire was sufficient to cause anomalous and unwanted voltages to appear on the skimmer. Nevertheless, even with the skimmer plate 46' optimally grounded, the signal to noise ration was improved by a factor of approximately 2 by correct RF biasing of the skimmer plate 46'.

Figure 3:
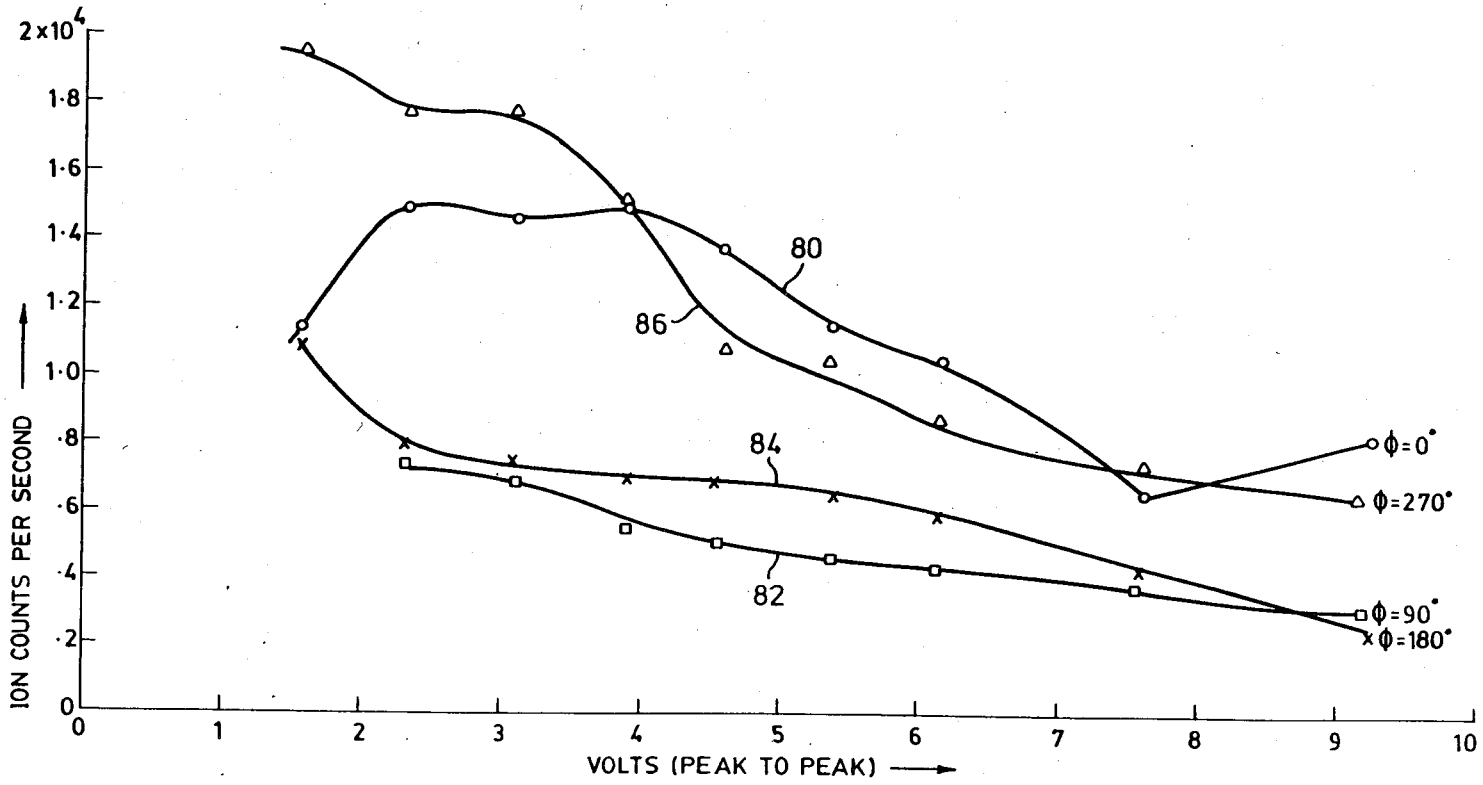
FIG. 3 is a graph showing ion transmission into the second stage of the vacuum chamber for several phases of the RF bias voltage, plotted against the peak-to-peak RF voltage applied to the skimmer plate for a particular orifice size.

In a second experiment the variation of ion signal with changes in the phase and amplitude of the RF bias applied to the skimmer plate 46' were carefully measured and plotted for several different phases and for two orifice sizes. FIG. 3 shows the results, where the voltage (RF peak-to-peak voltage) applied to the skimmer plate 46' is plotted on the X axis and the ion signal transmitted into the vacuum chamber (ion counts per second as detected by the mass spectrometer 52') is plotted on the Y axis. Four curves are plotted, namely curve 80 for a phase angle of 0°, curve 82 for a phase angle of 90°, curve 84 for a phase angle of 180° and curve 86 for a phase angle of 270°.

It is noted that the phase angles shown in FIG. 3 are arbitrary. They are simply the phase shift settings shown on the phase shift box used as the phase shift network 70'. The phases shown do not represent the phase differences between the RF voltage applied to the coil 12' and that applied to the skimmer plate 46' for the following reasons. Firstly, the generator 26' used had several stages of amplification and the lead 69' was connected to the generator 26' before its last stage of power amplification. It is expected that there was a phase shift in such last stage. Secondly, the lead from the generator to the coil 12' was about 3 meters long, causing about a $\frac{1}{3}$ wavelength or 120° shift between the RF voltage produced at the generator 26' and that applied to the plasma 30. Thirdly, there was a phase shift in the amplifier 72' and in the lead from the amplifier 72' cable to the skimmer plate 46'. In addition there was at the feed through 74' a resistance-capacitance network (not shown) to reduce the voltage from the amplifier to an optimum level, and this introduced a further phase shift. There was also a phase shift in the lead 69', from 70' to 72', and from 72' to 74'. It was not readily possible to measure directly the phase difference between the RF voltage in the plasma and the RF bias at the skimmer plate 46'. The phases plotted in FIG. 3 are therefore indicative only of the fact that some phases produce much better results than others.

It will be noted with reference to FIG. 3 that the optimum ion transmission occurred at about 1.5 volts and with a phase setting of 270°. The apparatus used could produce a bias voltage only down to 1 volt peak-to-peak, but it is believed that had lower voltages been used, the curve 86 would have turned down sharply at and below about 1 volt of bias, as evidenced by the loss in signal in the previous experiment where the feed through was grounded.

The FIG. 3 graph was produced using a sampler orifice 36' of size 0.027 inches in diameter. This was a relatively small orifice, and will be noted presently, the size of the sampler orifice 36' has a substantial influence on the effects produced by the RF bias voltage applied to the skimmer plate 46'.

Figure 4:
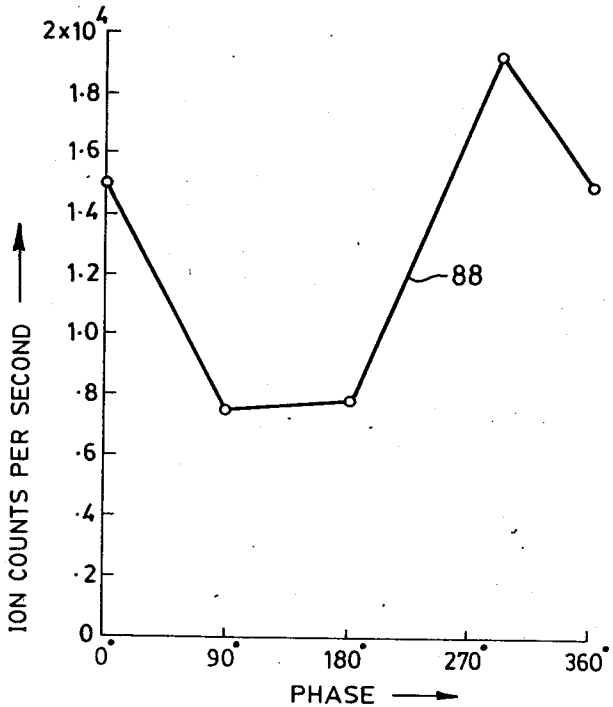
FIG. 4 is a graph showing the ion transmission into the second stage of the vacuum chamber plotted against the phase of the RF bias voltage for the orifice used in the FIG. 3 graph.

Curve 88 in FIG. 4 was produced using the same data used to produce the FIG. 3 graph. In FIG. 4 the ion transmission is plotted on the Y axis and the phase on the X axis. The same size sampler orifice was used as that for FIG. 3. A constant RF bias voltage of 2.32 volts peak-to-peak was applied to the skimmer plate 46'. It will be seen that the optimum ion transmission occurred at a phase setting of about 290°, and that the ratio between the best and worse ion transmission was approximately 2.5 at the bias voltage used.

Figure 5:
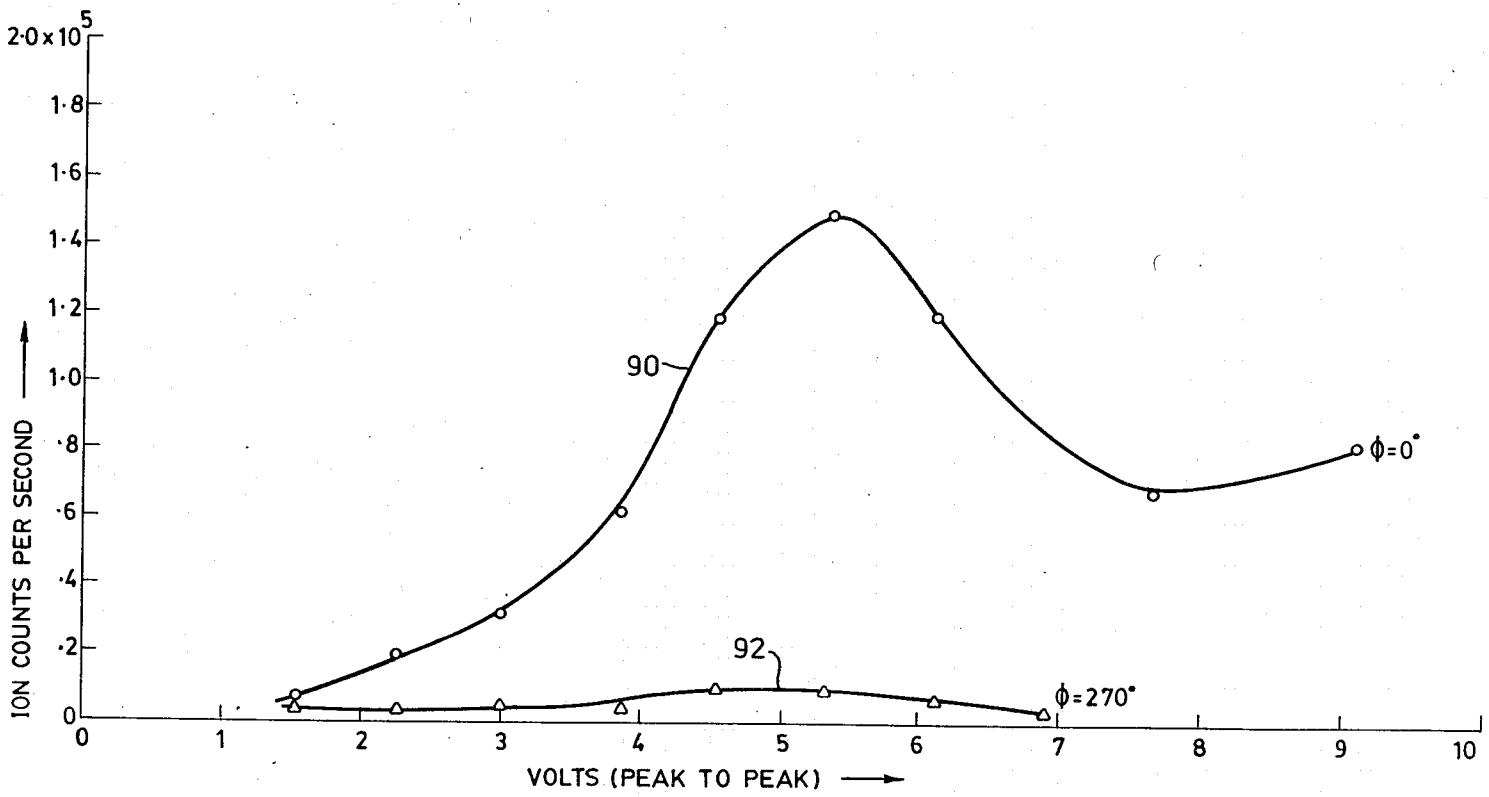
FIG. 5 is a graph similar to that of FIG. 3 but for a different size orifice.

Reference is next made to FIG. 5, which is a plot the same as that shown for FIG. 1 but with only two curves 90, 92 plotted. Curve 90 is for a phase setting of 0° and curve 92 is for a phase setting of 270°. For phase shifts of 90° and 180°, essentially no ion transmission occurred. For the FIG. 5 plot a larger sampler orifice 36' of 0.034 inch diameter was used. It will be seen that in this arrangement the best ion transmission occurred at a much higher skimmer bias voltage of about 5.4 volts peak-to-peak. The ration between the ion transmissions 0° and at 270° at this voltage was about 15. It is noted that the phase settings shown in FIG. 5 cannot be compared with those of FIG. 4 because a slightly different voltage dropping network (not shown) adjacent the feed through 74 was used for the FIG. 5 plot and would have produced a difference in the phase shifts.

Figure 6:
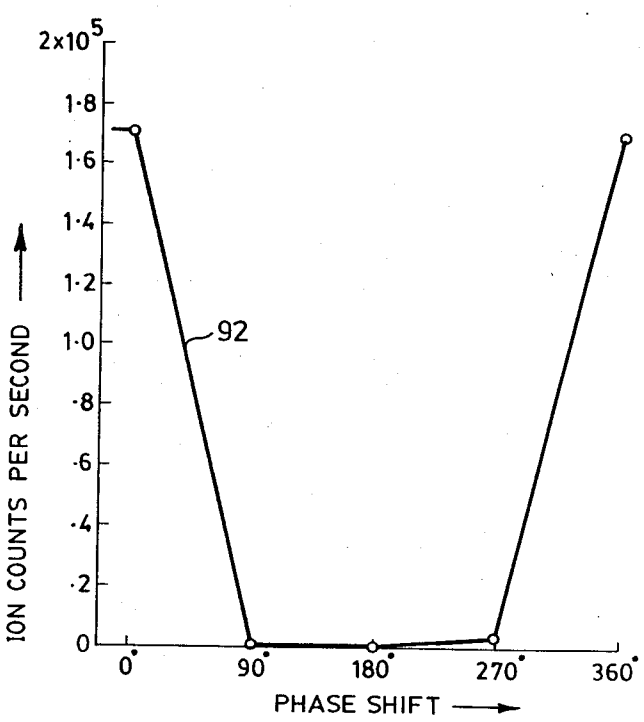
FIG. 6 is a graph similar to that of FIG. 4 but for the orifice used in connection with the FIG. 5 graph.

FIG. 6 is a plot similar to that of FIG. 4 but was produced using the same data as that used to produce FIG. 5, with a sampler orifice size of 0.034 inches and an RF bis voltage of 5.4 volts peak-to-peak. As shown, the best ion transmission occurred at 0° (or 360°). Ion transmission appeared virtually to cease between 90° and 270°.

Although the mechanisms involved are highly complex and not entirely understood, it is clear from the experiments that ion transmission can be optimized by applying an RF bias to the skimmer plate 46', provided that the bias is of correct phase and amplitude. In addition it is clear that the variation of ion transmission with changes in the phase and amplitude of the RF bias is greater with a larger diameter sampler orifice 36', and that higher RF bias voltages are required with the larger diameter sampler orifice for optimum ion transmission.

It is believed that the bias signal applied to the skimmer plate 46' produces greater effects with a larger diameter sampler orifice 36' for the following reasons. As mentioned, the heating currents in the plasma 30 cannot be eliminated, and therefore there will always be an RF voltage swing in the plasma (typically of up to about 10 volts) even when the coil 12' is center tapped. When a small diameter sampler orifice 36' is used, the skimmer plate 46' is better insulated from the plasma 30'. In this situation a cool boundary layer tends to form over the sampler plate 32' and, together with the smaller orifice 36', insulates the skimmer plate 46' from the RF voltage in the plasma. When the sampler orifice 36' is larger, the cool boundary layer is less pronounced and in addition the skimmer plate 46' is in better electrical contact with the plasma 30' and is driven harder thereby.

If the skimmer plate 46' were simply gounded, then for about ½ of the RF cycle the plasma 30' would be negative with respect to the skimmer plate 46' and formation of a positive ion beam from the plasma through the skimmer orifice 48' may be expected to be inhibited. If the RF bias applied to the skimmer plate 46' is always negative with respect to the plasma, then ion extraction may be favoured over the entire RF cycle rather than over only half the cycle. This may account for the approximately two-fold increase between the best grounded and RF biased cases.

In addition it appears that the ion optic system 56' may more favourably accept an ion beam if the skimmer plate 46' has a constant potential difference with respect to the plasma 30'. Ion optic transmission depends on the ion energy, which depends partly on the voltage on the skimmer plate 46' and partly on the voltage in the plasma. If the voltage difference between the skimmer plate 46' and the plasma 30' is kept constant, then it appears that the ion optic system 56' may be better able to transmit a consistently high proportion of the ions which enter it, as opposed to an arrangement in which the voltage is constantly varying. In addition, practical ion optics lens systems may more favorably accept an ion beam if the skimmer plate 46' is a few volts positive or negative with respect to the plasma. Thus a suitable RF bias may be expected to optimize the ion transmission through the ion optics lens system 56.

It was also noted that the background noise level varied with the RF bias (but remained relatively low in all cases). The reasons for this effect are not clear but two possibilities are suggested. The first is that the residual voltage swing remaining in the plasma may have been sufficient to cause a very weak discharge in the first stage 38' of the vacuum chamber (where the pressure was about 1 torr, as compared with about $10^{31\ 5}$ torr in most of the second stage). Biasing the skimmer plate correctly would reduce or remove this discharge, reducing the noise. Alternatively, there may have been a breakdown between the first ion optic element (near the base of the skimmer plate) and the skimmer plate, since the first ion optic element had a relatively high voltage applied to it and was in a region of fairly high gas density because of the jet of gas travelling through the skimmer orifice 48'. The discharge from the first ion optic element to the skimmer plate would be initiated by free electrons from the plasma 30'. If the skimmer is biased so as to permit a positive ion beam to be produced at all times during the full cycle, transmission of free electrons from the plasma may be inhibited and a breakdown at the first lens element reduced.

It is noted that the improvement produced in ion transmission signal, in the present experiments by a factor of 2, together with some noise reduction, can be achieved at minimal cost, simply by adding a few inexpensive electronic components.

The fact that smaller voltages are optimum with the smaller sampler orifice than with a larger sampler orifice is confirming evidence that the improved ion transmission effect is truly associated with the potential difference between the plasma and skimmer and is not solely an ion optics effect.

Although the bias voltage or voltages were shown as derived from the generator 26 or 26' and were therefore phase locked to the RF voltage applied to the coil 12 or 12', a separate bias voltage generator can be used, phase locked to the generator 26 or 26'.

I claim:

1. Apparatus for sampling ions in a plasma into a vacuum chamber comprising:

(a) means for generating a plasma, including (i) an electrical induction coil having first and second terminals and at least one turn between said first and second terminals, said turn defining a space within said coil for generation of said plasma, and (ii) generating means for generating a first RF voltage to apply to said coil to provide heating within said space to generate said plasma, (b) a vacuum chamber including an orifice plate defining a wall of said vacuum chamber.

(c) said orifice plate having an orifice therein located adjacent said space for sampling a portion of said plasma through said orifice into said vacuum chamber, (d) second generating means for generating a second RF voltage of frequency the same as that of said first RF voltage and phase locked to said first RF voltage, (e) and means connected between said orifice plate and said second generating means for biasing said orifice plate with said second RF voltage to increase the flow of said ions through said orifice.

2. Apparatus according to claim 1 wherein said first generating means includes means for producing said second RF voltage, said first generating means thereby including said second generating means.

3. Apparatus according to claim 2 and including means for adjusting the phase of said second RF voltage.

4. Apparatus according to claim 1 and including means for adjusting the amplitude of said second RF voltage.

5. Apparatus for sampling a plasma into a vaccum chamber comprising:

(a) means for generating a plasma, including (i) an electrical induction coil having first and second terminals and at least one turn between said first and second terminals, said turn defining a space within said coil for generation of said plasma, and (ii) RF generating means for generating a first RF voltage to apply to said coil to provide heating within said space to generate said plasma, (b) a vacuum chamber having first and second vacuum stages and including a sampler plate defining an outer wall of said vacuum chamber, said sampler plate having a sampler orifice therein, and a skimmer plate within said vacuum chamber and having a skimmer orifice therein, said sampler plate and skimmer plate being spaced to define between them said first vacuum stage, said vacuum chamber having a secon wall spaced from said skimmer plate, said second wall and said skimmer plate defining between them said second vacuum stage, (c) said sampler orifice and said skimmer orifice being located to sample a portion of said plasma through said sampler orifice into said first vacuum stage and through said skimmer orifice into said second vacuum stage, (d) and means coupled to said RF generating means for producing a first RF bias voltage and for applying said RF bias voltage at least to said skimmer plate to increase the flow of said ions through said skimmer orifice.

6. Apparatus according to claim 5 including means coupled to said generating means for producing a second RF bias voltage and for applying said second RF bias voltage to said sampler plate whereby to increase the flow or ions through said sampler orifice.

7. Apparatus according to claim 6 and including means for adjusting the phase of said second bias voltage.

8. Apparatus according to claim 7 and including means for adjusting the amplitude of said second bias voltage.

9. Apparatus according to claim 6 and including means for independently adjusting the phases of each of said first and second bias voltages.

10. Apparatus according to claim 7 and including means for independently adjusting the amplitudes of each of said first and second bias voltages.

11. Apparatus according to claim 5 and including circuit means coupled to said coil to reduce the peak-to-peak voltage swing in said plasma.

12. Apparatus according to claim 11 and including means for adjusting the phase of said first bias voltage.

13. Apparatus according to claim 12 and including means for adjusting the amplitude of said first bias voltage.

14. Apparatus according to claim 5 wherein said vacuum chamber includes a mass analyzer therein.

15. Apparatus according to claim 11 wherein said vacuum chamber includes a mass analyzer therein.

16. Apparatus according to claim 12 wherein said vacuum chamber includes a mass analyzer in said second vacuum stage, said mass analyzer including a quadrupole mass spectrometer.

17. A method of sampling ions in a plasma into a vacuum chamber comprising:

(a) applying a high frequency electrical current to a coil to generate a plasma within said coil, (b) reducing the peak-to-peak voltage variations in said plasma by limiting the voltage variations in said coil at a position between the ends thereof, (c) directing a portion of said plasma through a sampler orifice into a first stage of said vacuum chamber and then through a skimmer orifice into a second stage of said vacuum chamber, (d) and applying an RF bias voltage of the same frequency as said electrical current to said skimmer orifice to increase the ion transmission therethrough.

18. The method according to claim 17 and including the step of adjusting the phase and amplitude of said RF bias voltage for optimum ion transmission.

19. The method according to claim 18 and including the step of analyzing said ions which enter said second stage of said vacuum chamber.

* * * * *